United States Patent [19]

Bak et al.

[11] Patent Number: 4,800,949

[45] Date of Patent: Jan. 31, 1989

[54] METHOD AND INSTALLATION FOR THE CONTINUOUS MANUFACTURE OF PIPES FROM SPHEROIDAL GRAPHITE CAST-IRON HAVING A CONTROLLED STRUCTURE

[75] Inventors: Claude Bak, Loisy; Rio Bellocci, Pont-a-Mousson; Yves Gourmel, Blenod-Les-Pont-à-Mousson; Michel Pierrel, Maidieres, all of France

[73] Assignee: Pont-A-Mousson S.A., Nancy, France

[21] Appl. No.: 131,250

[22] Filed: Dec. 3, 1987

Related U.S. Application Data

[63] Continuation of Ser. No. 808,805, Dec. 13, 1985, abandoned.

[30] Foreign Application Priority Data

Jan. 4, 1985 [FR] France ..... 85 00159

[51] Int. Cl.[4] ..... B22D 11/124

[52] U.S. Cl. ..... 164/460; 164/464; 164/421; 164/477; 164/417; 164/444; 164/486; 29/527.6; 148/3

[58] Field of Search ..... 164/486, 444, 487, 455, 164/414, 421, 484, 417, 477, 464; 29/527.6; 148/2, 3

[56] References Cited

U.S. PATENT DOCUMENTS

| | | | |
|---|---|---|---|
| 3,473,600 | 10/1969 | Ayers | 164/444 X |
| 4,146,079 | 3/1979 | Anisovich et al. | 164/421 X |
| 4,236,571 | 12/1980 | Pierrel et al. . | |
| 4,420,029 | 12/1983 | Kameyama | 164/417 X |
| 4,448,610 | 5/1984 | Bellocci . | |
| 4,473,105 | 9/1984 | Pryor | 164/486 X |
| 4,628,987 | 12/1986 | Gourmel et al. . | |

FOREIGN PATENT DOCUMENTS

| | | | |
|---|---|---|---|
| 57-100846 | 6/1982 | Japan | 164/477 |

*Primary Examiner*—Kuang Y. Lin

*Attorney, Agent, or Firm*—Sughrue, Mion, Zinn, Macpeak & Seas.

[57] ABSTRACT

The invention concerns a method and apparatus for thermally treating cast-iron pipes formed in a continuous casting die. The pipe or tube undergoes tempering by passing through a vat which is located downstream from the continuous casting die. The vat contains a continuously cooled bath of fluidized sand or the like which lowers the temperature of the tube in a uniform manner and makes it possible to obtain a very precise and homogeneous tube structure.

9 Claims, 6 Drawing Sheets

METHOD AND INSTALLATION FOR THE CONTINUOUS MANUFACTURE OF PIPES FROM SPHEROIDAL GRAPHITE CAST-IRON HAVING A CONTROLLED STRUCTURE

This is a continuation of application Ser. No. 808,805, filed Dec. 13, 1985, now abandoned.

The present invention relates to the manufacture by continuous casting of pipes from spheroidal graphite cast-iron and to a thermal treatment subsequent to this continuous casting, with a view to giving the pipes a structure suitable for use, for example but not exclusively, a bainitic structure.

French Patent Application No. 84 00 382 filed on Jan. 10, 1984 discloses the manufacture by vertical continuous bottom casting of a cast-iron metal tube, without using a core.

French Pat. No. 24 15 501 discloses the manufacture of a pipe from cast-iron by continuous vertical top casting, with the use of a core for forming the cavity of the body of the pipe.

Moreover, French Pat. No. 25 22 291 discloses the manufacture of a centrifugally cast tube from spheroidal graphite cast-iron having a bainitic structure due to thermal treatment following the centrifugal casting.

According to this patent, on the one hand the thermal treatment is carried out very advantageously by beginning the tempering stage directly in the centrifugal chill mould, which makes it possible to save a considerable amount of time and to save on heating energy for the thermal treatment and on the other hand a bainitic structure is obtained which is advantageous with respect to the normal ferritic structure of cast-iron pipes. In fact, the bainitic structure of the spheroidal graphite cast-iron pipe makes it possible to appreciably improve the limit of elasticity and the breaking-strength for the same value of elongation and, if one wishes to produce cast-iron tubes having the mechanical characteristics normally required, an appreciable lightening of weight by reducing the thickness of cast-iron pipes having a bainitic structure with respect to known pipes having a ferritic structure.

The known method for the production of pipes from cast-iron by centrifugal casting is a discontinuous production method. It has the advantage of allowing austenitic tempering in situ, i.e. inside the centrifugal chill mould, as shown in French Pat. No. 25 22 291.

The applicant has tackled the problem of obtaining a tube from spheroidal graphite cast-iron having a predetermined structure, for example, but not exclusively bainitic, in the manufacture by continuous casting and in particular a homogeneous structure over the entire wall of the tube and this is in a manner which can be reproduced industrially, despite the low aptitude of spheroidal graphite cast-iron for tempering.

This problem is resolved by the method of the invention.

The invention relates to a method for the continuous production of a tube from spheroidal graphite cast-iron having a homogeneous and controlled structure, chosen from structures containing bainite, bainite and ferrite, or ferrite and perlite, this method of the type in which a tube is formed by a method of continuous casting inside a cooled tubular die, from a cast-iron having the following composition by weight: carbon, 2.5 to 4.0%, silicon, 2 to 4%, manganese, 0.1 to 0.6%, molybdenum 0 to 0.5%, nickel, 0 to 3.5%, copper, 0 to 11%, magnesium, 0 to 0.5%, sulphur, 0.1% maximum, phosphorus, 0.06% maximum, the rest being iron, this method being characterised in that at the outlet of the cooled tubular die, the cast-iron tube which has just been produced is made to pass through a fluidized bath of solid refractory particles cooled to a temperature substantially lower than the temperature of the cast-iron pipe as it is formed at the outlet of the cooled tubular die.

The invention also relates to an installation for carrying out this method, this installation of the type comprising means for the continuous casting of a tube from spheroidal graphite cast-iron, being characterised in that it comprises downstream of the cooled die for continuous casting, a vat for the fluidization of solid refractory particles, the said vat being provided with a tubular coil for water for cooling the fluidized bath in which the coil is immersed and the said vat comprising at least one inlet orifice or outlet orifice for the tube which has to pass through the fluidized bath of said particles in the vat.

Owing to this method and this installation, the thermal cooling treatment undergone by the tube of spheroidal graphite cast-iron, continuously, at the outlet of the continuous die, is perfectly uniform and reproducible, which makes it possible to obtain a very precise and homogeneous tube structure. In particular, immediately following the casting of the cast-iron pipe by thermal treatment in a fluidized bath of refractory particles makes it possible to obtain a greater aptitude for hardening of the cast-iron than that which one would have had by allowing the cast pipe to cool and by reheating it in order to temper it subsequently. The invention in fact makes it possible to move directly away from a structure which has not yet been treated, i.e. virgin cast-iron pipe leaving the casting die.

Other features and advantages will become apparent from the ensuing description:

BRIEF DESCRIPTION OF THE DRAWINGS

In the accompanying drawings, given solely by way of example.

Figure 1:
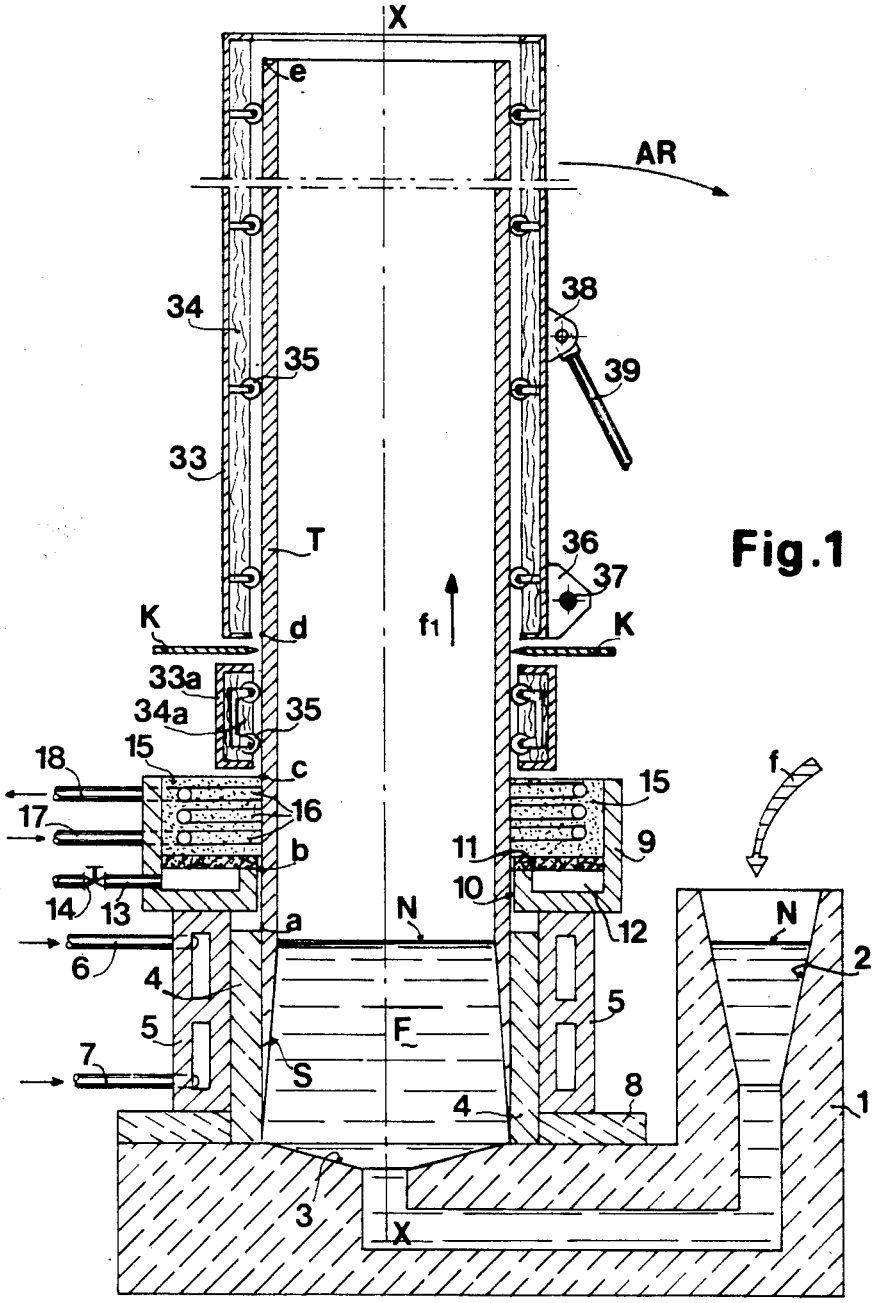
FIG. 1 is a diagrammatic sectional view of an installation according to the invention for continuous bottom casting of a tube without a socket.

According to the embodiment illustrated in FIG. 1, the invention is applied to the continuous bottom casting of a tube T from cast-iron.

The installation of the invention comprises:

(1) A supply of molten cast-iron by a siphon unit:

A siphon unit 1, or refractory material, for example of the silico-aluminous type, essentially comprises an L-shaped casting pipe comprising a casting funnel 2 at its upper end, constituting a supply under load and, at its lower end, a bottom casting orifice 3 at the base of a die for the formation of the tube T.

(2) An externally cooled crucible or die:

Mounted on the axis XX of the bottom casting orifice 3 is a cooled tubular die or crucible comprising a graphite sleeve 4 on the axis XX whereof the inner diameter corresponds to the outer diameter of the tube T to be produced and a jacket 5, for example of copper, for the circulation of cooling water which enters through a pipe 6 and leaves through a pipe 7. The graphite sleeve 4 rests directly on the siphon unit 1. The cooling jacket 5 mounted around the sleeve 4, in contact with the latter over virtually its entire height, is not in direct contact with the siphon unit 1 but is separated therefrom by a refractory annular spacing stand 8. The upper part of the cooling jacket 5 is located above the upper edge of the graphite sleeve 4. It is the arrangement of the sleeve 4 and jacket 5 which constitutes the cooled crucible or die.

(3) A thermal treatment apparatus in three parts:

(A) A fluidization vat for immersing the tube T in a fluidized medium at a controlled temperature.

(B) A sleeve for insulating the tube T in order to slow down its cooling.

(C) And as known per se, a tunnel furnace for maintaining the temperature of the tube T.

(a) According to the invention, the fluidization vat is mounted on the axis XX of the die (4-5) and of the cast-iron tube T to be obtained, above the die (4-5), thus downstream of the latter. It comprises a vessel 9 or vat which is open to the atmosphere at its upper end, resting for example on the upper edge of the cooling jacket 5 or resting on a frame which is not shown. The vat 9 has an annular base on the axis XX comprising a circular opening 10 corresponding to the outer diameter of the cast-iron tube T which passes freely through the latter. Fixed above the annular base comprising an opening 10 and parallel to this base is a porous plate 11, which is spaced from the said base in order to provide a chamber 12 for the inlet of air at a given pressure, for example comprised between two and eight bars. Compressed air is admitted to the chamber 12 through a pipe 13 under the control of equipment 14 comprising for example a relief-valve and a pressure gauge which are not shown. Located above the porous plate 11 is the fluidization chamber which is open to the atmosphere, which contains a certain quantity of solid particles, preferably refractory particles, to be fluidized, for example sand 15, or equally well silica or alumina. Located in this fluidization chamber is a certain number of tubular turns 16, wound in a helix having a diameter comprised between the outer diameter of the vat 9 and that of the opening 10. Cooling water entering through a pipe 17 and leaving through a pipe 18 passes through the tubular turns 16.

According to the invention, a shaft 33 of inner diameter greater than the outer diameter of the tube T to be formed is mounted above the vat 9 and on the same axis X—X. The shaft 33 surrounds an insulating sleeve 34, for example constituted by a felt of mineral fibres. This shaft 33 is provided to slow down natural cooling of the tube T. The thicker the insulating sleeve 34 and the slower the cooling of the tube T. The height of the shaft 33 is at least equal to the length of tube T to be cut off.

Figure 2:
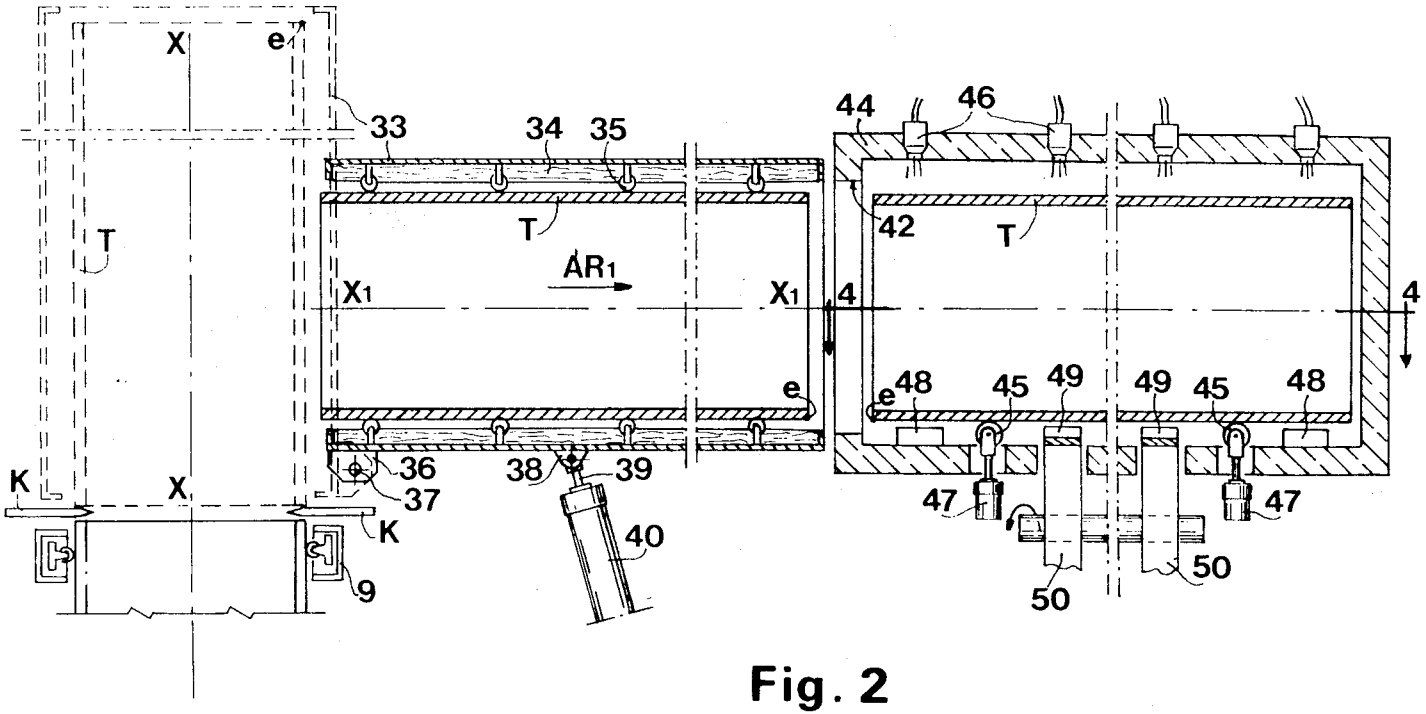
FIG. 2 is a diagrammatic sectional view complementing FIG. 1 for illustrating the thermal treatment installation of the invention.
Figure 3:
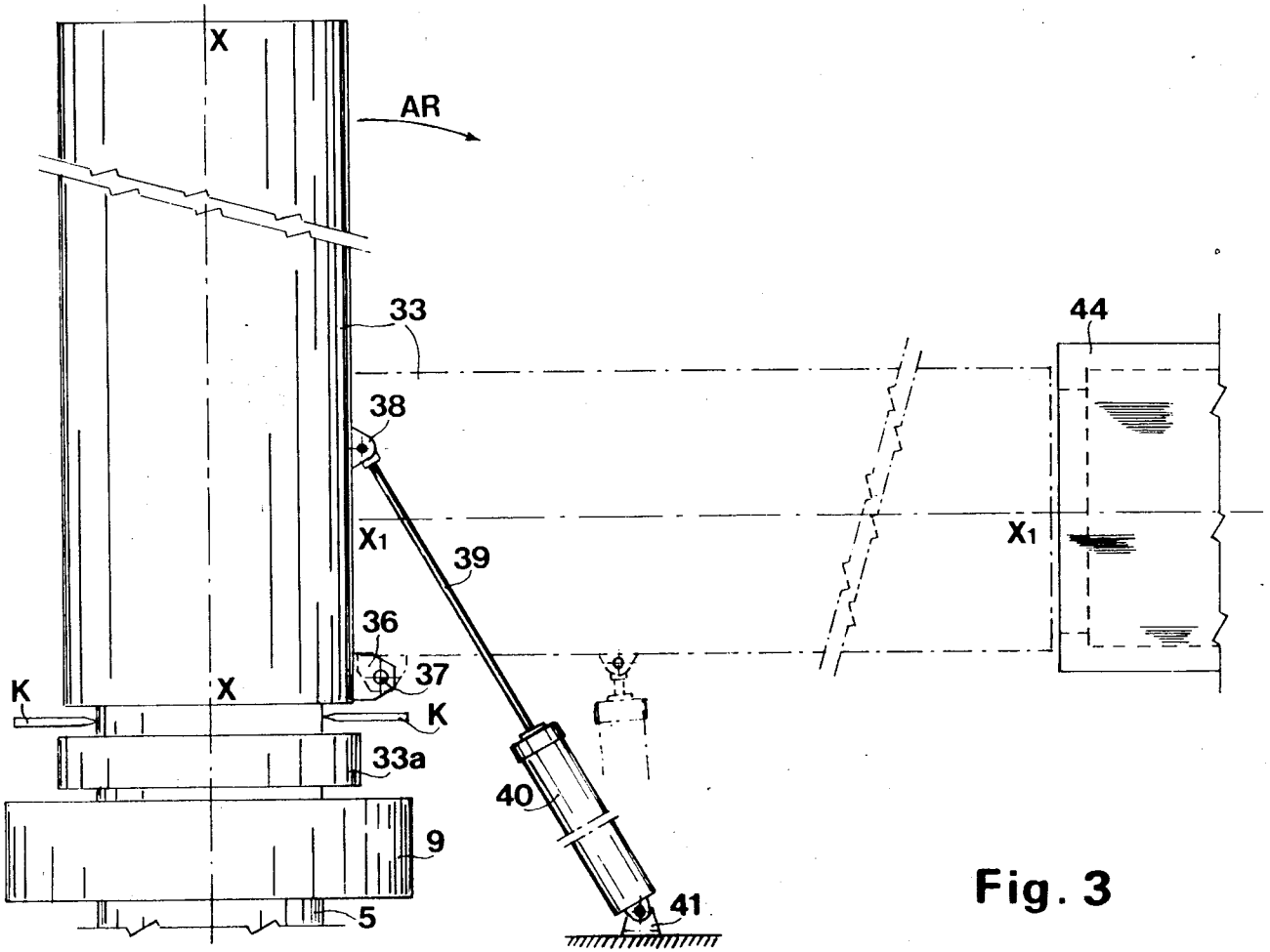
FIG. 3 is a diagrammatic view in elevation of a mechanical detail of the thermal treatment installation of the invention.

According to the invention, the shaft 33 comprises on its inside rollers 35 for guiding and supporting the tube T. These rollers 35, projecting internally with respect to the insulating sleeve 34, are aligned to be parallel with the generatrices of the cylindrical shaft 33 on the axis XX and with those of the tube T. At least part of the rollers 35 are driven in order to advance the tube T. Also according to the invention, the shaft 33 and the insulating sleeve 34 which it contains are mounted "to tilt". The shaft 33 may tilt by an angle of 90° in that it supports at its lower end, on the tilting side, an articulation lug 36 (FIGS. 2–3). Fixed securely to the lug 36 is a horizontal journal 37 on the axis XY which is at right angles to the axis XX. For the purpose of its tilting, above the lug 36, the shaft 33 comprises a tilting lug 38 on which is pivoted the end of the rod 39 of a tilting jack 40 whereof the body is pivoted, as known, on a frame 41 at the end remote from the piston rod 39 (FIG. 3). The jack 40 is for example of the double-acting hydraulic type. In this example (FIG. 3), in the extended position of the rod 39 (shown in full line) the shaft 33 is vertical (axis X—X) and, in the retracted position of the rod 39 (shown in dot dash lines), the shaft 33 is horizontal (axis X1—X1) as an extension of the entrance to the temperature-maintaining furnace 44 described hereafter. The jack 40 thus causes the shaft 33 to tilt in the direction of arrow AR.

(c) As known, a tunnel furnace 44 (FIGS. 2 and 4) for maintaining the temperature of the tube T is provided as an extension of the sleeve 34 and of the shaft 33 when the latter is laid down on the axis X1—X1, but extends in a horizontal direction AR2 which is perpendicular to the axis X1—X1 or to a direction AR1 parallel to X1—X1. The tunnel furnace 44, open at its two ends, comprises a lateral inlet opening 42 on the axis X1—X1 and an outlet opening 43 on a horizontal axis parallel to the direction AR2. For the passage through the tunnel of each tube T, with a change of direction through 90° between the axis X1—X1 (or the direction AR1) and the direction AR2, the tunnel furnace 44 comprises the following means for supporting and advancing successive tubes T: it comprises retractable rollers 45 for supporting and advancing the tube T in the direction of the arrows AR1 parallel to the axis X1—X1. For the purpose of this advance movement, at least part of the rollers 35 of the sleeve 34 and of the rollers 45 of the furnace 44 are driven in known manner and which is not shown. The rollers 45 are supported by vertical jacks 47 intended to retract them below the tracks 48 of direction AR2. The tracks 48 which support the tubes T are perpendicular to the generatrices of each tube T entering the furnace 44. In order to move successive tubes T forwards in the tunnel furnace 44 in the direction AR2, twin endless chains 49 are provided which are supported by wheels 50 driven in a manner which is not shown. Finally, the tunnel furnace 44 comprises a certain number of burners 46 (for example gas burners) creating internally a heating atmosphere for maintaining the temperature of the tube T.

(4) A tube extractor:

The latter is located just at the outlet of the fluidization vat 9, but upstream of the cutting device K. It is constituted for example by a section of shaft **33*a* comprising insulating sleeve 34*a* (similar to the shaft 33 and to the sleeve 34) and it essentially comprises driven rollers 35** for entraining the tube T in an upwards direction.

(5) A device for cutting the tube:

Located downstream of the fluidization device 9 comprising a trough and of the extractor 33*a* is a cutting device K known per se, illustrated symbolically by two opposing blades. The cutting device K is interposed for example between the extractor 33*a* and the shaft 33.

Figure 4:
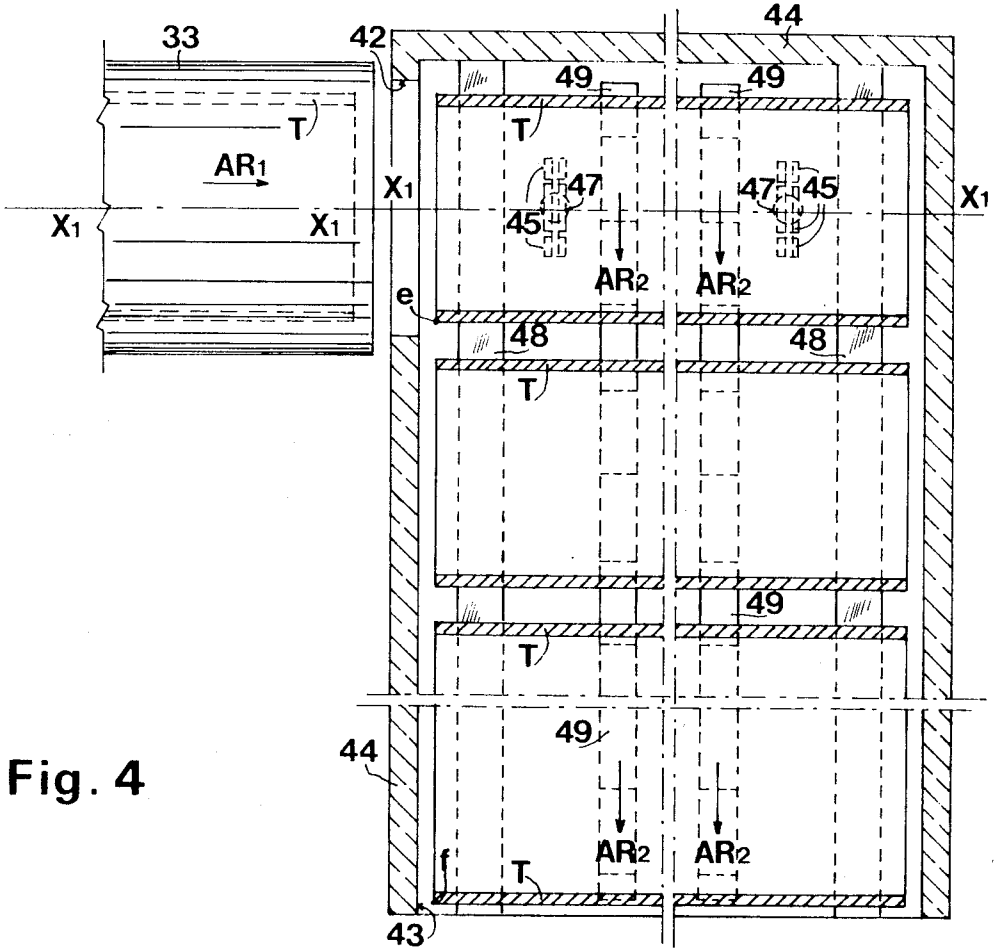
FIG. 4 is a partial diagrammatic sectional view on line 4—4 of FIG. 2 of part of the thermal installation.

Operation and carrying-out of the thermal treatment of the invention (FIGS. 1, 2 and 4)

Even before introducing molten cast-iron into the installation, in order to start production of a tube T, a manikin or false tube (not shown) constituted by a tubular steel sleeve of the same outer diameter and of the same thickness as the tube T to be obtained is introduced from the top of the die 4-5, through the fluidization and thermal treatment vat 9, to a level lower than that of the upper end of the graphite sleeve 4. Then molten cast-iron is introduced in the direction of arrow f into the casting funnel 2 up to a level N situated slightly below the upper part of the sleeve 4 of the die 4-5. This molten cast-iron has the following composition by weight: carbon 2.5 to 4%, silicon 2 to 4%, manganese 0.1 to 0.6%, molybdenum 0 to 0.5%, nickel 0 to 3.5%, copper 0 to 11%, magnesium 0 to 0.5%, sulphur 0.1% maximum, phosphorus 0.06% maximum, the remainder being iron. The vat 9, which is initially empty of sand before the introduction of the manikin, is filled with sand at 15, in the fluidization chamber, as soon as the manikin is immersed below the level N. In fact, the manikin thus provides the tubular inner wall which was missing in order to contain a mass of sand 15 which can then be introduced. The cooling water is admitted through the pipe 6 and 7 for the jacket 5 and 17 and 18 for the tubular turns 16.

As known, the cast-iron cools in contact with the sleeve 4 along a solidification front S of approximately frustoconical shape and becomes attached to the manikin which is drawn upwards by the motorised rollers 35 of the shaft 33*a*, then the shaft 33 and entrains, step by step, the part of solidified cast-iron in the form of the beginning of a tube T.

Later, whilst the manikin is still travelling through the vat 9 in the direction of arrow f1, compressed air or nitrogen is admitted through the pipe 13 into the chamber 12 for the inlet of fluidization gas. The mass of sand 15 is then fluidized all around the turns 16 which are embedded in the fluidization bath 15, up to a level close to the upper level of the vat 9, thus appreciably above the level of the mass of sand 15, before fluidization, when it is inert. When it is the beginning of the tube T which replaces the manikin inside the fluidization vat 9, rising in the direction of arrow f1, the thermal treatment of the tube T begins and proceeds continuously as it rises in the direction of arrow f1.

Figure 5:
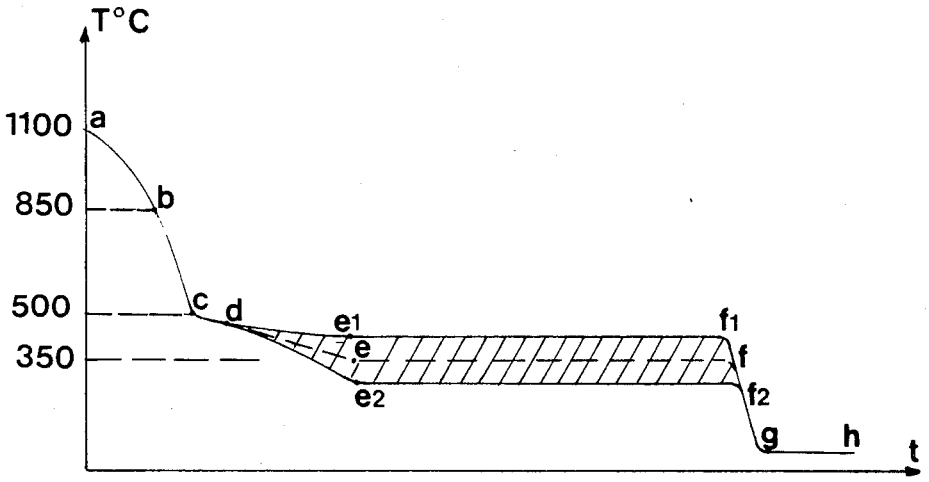
FIG. 5 is a thermal treatment diagram showing the line of evolution of temperature of a cast-iron tube, during the time of the thermal treatment, in order to obtain a bainitic structure.

The thermal treatment for the bainitisation of the tube T is carried out under conditions of evolution of temperature illustrated in FIG. 5 and described in French Pat. No. 2 522 291:

First stage (abc) of bainitisation tempering

In the curve of FIG. 5, the temperature (T° C.) are shown on the Y-axis whereas the times (t) are shown on the X-axis. The curve a . . . h of FIG. 5 illustrates the evolution of the temperature of a tube of spheroidal graphite cast-iron at the time when it undergoes the the thermal treatment of the invention.

It is in the fluidization vat 9, where the bath of fluidized sand 15 is at a temperature regulated to the value necessary for obtaining the desired structure (for example between 100° and 200° C. for a bainitic structure) that the first stage of the thermal treatment is carried out, the said stage being bainitisation tempering, without heating, taking advantage of the heat from the tube emerging from the die 4-5. This temperature of the bath of sand 15 comprised between 100° and 200° C. is kept constant owing to the circulation of water at a temperature of the order of 20° C. in the pipes 17 and 18. The cooling intensity of the bath of sand 15 depends on the rate of flow of fluidization air entering through the pipe 13 and on the circulation speed of the water. The rate of flow of fluidization air and the water circulation speed are adjustable. One thus starts with a tube T which has just been formed and solidified and is still at a temperature of 1100° C. at the point a (outlet of the die 4). Between the points a and b (at the level of the porous plate 11), the temperature of the tube T drops rapidly from approximately 1100° C. to approximately 850° C. or to a slightly higher temperature. At the points a and b, the structure of the tube T is austenitic.

From the point b (entry into the fluidization bath 15) to the point c (outlet of the fluidization bath 15), the drop in temperature of the tube T is sudden (from 850° C. to approximately 500° C.) and takes place in a very short time, during the passage through the fluidization bath 9, where the tube T is licked over its entire surface by the bath of fluidized sand 15 kept by the coil 16 at a temperature of the order of 100° to 200° C. It is bainitisation tempering. The fluidized bath thus causes a real intense drainage of heat from the tube T formed and this is in a uniform manner over the entire wall of the tube T immersed in the bath of sand 15, in order that each point of the tube T undergoes the same thermal treatment.

(2) Intermediate stage c d e of leaving the bath 9 and passing through the extractor 33*a* and the shaft 33

Having barely left the fluidization vat 9, the tube T enters the extractor 33*a*, which whilst protecting it against cooling, entrains it by its motorised rollers 35 towards the shaft 33 for natural and slow cooling which is located in the position of a vertical axis, through the cutting device K. On the temperature curve of FIG. 5, the entrance to the shaft 33 corresponds to the point d. Thus the interval for the passage through the extractor 33*a* between the vat 9 and the shaft 33, where the cutting device K is located, corresponds to the portion of the curve c d, with a slight drop in temperature of the outer wall of the tube T: the point d is at a temperature close to 480° C. The cooling of the tube T in this shaft 33 is slow owing to the insulating sleeve 34 of the shaft 33. On leaving the shaft 33, at the point e, the pipe T is at a temperature of the order of 350° C.

Cutting up of the tube T is carried out by means of the cutting device K, when the desired length of tube T is inside the shaft 33.

(3) Second stage of thermal treatment—maintaining temperature (area comprised between the portions e1 f1 and e2f2 of the curve of FIG. 5)

In order to consolidate or fix the bainitic structure previously obtained, the cut tube T is conveyed inside the tunnel furnace 44 moving it in a direction AR1 parallel to the horizontal axis X1—X1 of the tilted shaft 33. In order to do this, (FIGS. 2 and 3) after cutting of the tube T to the desired length by the device K, the jack 40 is actuated in order to tilt the shaft 33 and the tube T which it contains and supports, by an angle of 90° in the direction or arrow AR about the axis YY of the journal 37. The shaft 33 tilts as far as the end of travel of the rod 39 of the jack 40 (portion shown in dot dash lines in FIG. 3). It thus passes from the position on a vertical axis XX to the position on a horizontal axis X1—X1 in the extension of and in the vicinity of the entrance 42 of the tunnel furnace 44. The tube T, supported by the rollers 35 during this tilting as well as in the new position X1—X1 is thus ready to enter the tunnel furnace 44. The motorised rollers 35 then the motorised rollers 45 which are set in rotation cause the tube T to enter the tunnel furnace 44. Inside the furnace 44, the tube T, whilst continuing to move forwards horizontally, undergoes a change of direction by 90° in the new direction AR2 which takes it to the outlet 43 of the furnace 44. This change of direction is carried out in the following manner: the jacks 47 retract the rollers 45 from below the tracks 48 so that the tube T is deposited on the tracks 48 and the endless driving chains 49 which entrain it in the new direction AR2 as far as the outlet 43 of the furnace. The tunnel furnace 44 is heated by gas burners 46 to a temperature such that the tube T moving forwards along the tunnel furnace 44 at an adjustable speed (by regulating the entrainment speed of the driving chains 49) is kept at a constant isothermal temperature comprised between two limits (two isotherms): on the one hand an upper limit (portions e1f1 or isotherm of 450° C. of FIG. 5) and on the other hand a lower limit (portions e2f2 or isotherm of 250° C.). Between the limits e1f1 and e2f2, maintaining the temperature of the tube T takes place along an intermediate portion or isotherm e f, comprised between 250° C. and 450° C., (FIG. 5), it is in the shaft 33 that the tube T passes from the temperature d (entrance to the shaft 33) to the temperature e (outlet of the shaft 33 and entry into the furnace 44) comprised between the temperature e1 and e2, respectively of 450° C. and 250° C. This stage of thermal treatment in the maintaining furnace 44 ensures the stability of the bainite and possibly of the residual austenite in the matrix of the structure. It is the maintenance of bainitisation which ensures a homogeneous bainitic structure or homogeneous bainitic austenitic structure. Beyond the points f1 or f2, the tube is cooled as described hereafter in paragraph 4.

The tube T leaves the tunnel furnace 44 at a temperature comprised between 450° C. and 250° C. between the points f2 and f1 in order to be cooled in the third and last stages as described hereafter in paragraph 4. It is thus inside the shaded area of FIG. 5 comprised between the portions e1f1 and e2f2 (portion e f in broken line) that the tube T is maintained at a constant temperature. The bainitic structure or possibly bainitic-austenitic structure is homogeneous and provides the optimum mechanical characteristics mentioned in French Pat. No. 2 522 291.

(4) Third and last stage of cooling in the atmosphere: portions f1 gh or f2 gh)

On leaving the tunnel furnace 44, the tube T cools in the atmosphere to normal temperature, for example comprised between 5° and 25° C., according to portion f1g, in a short time and finally maintains this temperature which is that of the atmosphere (portion gh). The tube T of spheroidal graphite cast-iron thus has a bainitic structure or mixed bainite-austenite structure.

It is thus possible to form and thermally treat castiron tubes, preferably water supply tubes, of nominal diameters of 600 to 2500 mm and more particularly of 1000 to 1600 mm with thickness comprised between 5 and 20 mm. This method and this installation are thus particularly advantageous for the manufacture of castiron tubes T of large diameter and relatively small thickness.

Advantages

The first stage of tempering begins at the point b of the curve of FIG. 5 taking advantage of the heat of the tube T formed without applying heat, in order to bring the tube T to the temperature of 800° to 850° C. approximately.

Owing to the combination of the "die 4-5+vat 9" one obtains an aptitude for tempering of the tube T of spheroidal graphite cast-iron which is much higher than the aptitude for tempering of a tube of spheroidal graphite cast-iron T which have been left to cool then have been reheated up to a temperature of 800° to 850° C. in order to carry out bainitic tempering.

The use of the vat 9 comprising a bath of fluidized sand 15 ensures the uniformity of temperature of the tube T over its entire length and over its entire cylindrical wall and ensures the reliability, reproducibility of the thermal treatment.

Moreover, the use of the bath of fluidized sand 15, or of any other suitable particles of a solid material as means for the discharge or drainage of heat from the tube T towards the outside, instead of cooling water, is a safety measure owing to the proximity of the bath of cast-iron F.

As one has seen in the preamble, owing to the immediate succession or linking together of the die (4-5) and of the vat 9, i.e. owing to the combination of the die 4-5 and of the fluidization vat 9, allowing bainitisation tempering (portions b c of FIG. 5) immediately after the tube T begins to be formed, i.e. at the outlet of the die 4-5, one obtains an aptitude for tempering which is much higher than the aptitude for tempering of a tube which would have been left to cool to a temperature lower than that of the eutectoid (700° to 750° C.), then which would have been reheated to a temperature of 850° C. to carry out subsequent bainitic tempering. The invention thus makes it possible to obtain the desired bainitic structure with certainty.

As will be seen hereafter, it also makes it possible to obtain with certainty other structures depending on the temperature of the bath of fluidized sand. Owing to the ease with which the temperature of the fluidized bath 15 can be regulated (by regulating the temperature and rate of flow of water circulating in the coil 16) and owing to the uniformity of temperature of the tube T treated by the bath of fluidized sand 15, over the entire length of the tube T, this thermal treatment is perfectly reliable and can be reproduced industrially.

Variations

According to the embodiment of FIG. 5, the method and installation for thermal treatment of the invention are applied to continuous vertical top casting of a cast-iron tube T.

Such an installation, of the type described in French Pat. No. 2 415 501 is built around a continuous casting axis XX. It comprises:

- a supply of molten cast-iron
- means for forming a cast-iron tube
- an installation for the thermal treatment of the cast-iron tube.

(1) Supply of molten cast-iron (partly illustrated):

A casting basin 19 at the upper end of the installation belongs to a casting ladle which is under low pressure, not shown, or possibly an electrical reverberatory furnace, the chamber of which is subject to the pressure of a neutral gas such as nitrogen or argon. At its lower end the casting basin 19 comprises a casting orifice 20 on the axis XX.

(2) Means for forming a cast-iron tube:

Passing axially through the casting orifice 20 is a graphite core 21 which produces the internal shape of the tube T to be obtained and the head 22 of a die 23 also of graphite providing the external shape of the tube T to be obtained. The core 21 is a hollow cylinder containing internally a heating device, for example an inductor 24 in the form of a coil cooled by water. With the core 21, the die 23 provides an annular space 25 corresponding to the internal and external dimensions of the tube T to be obtained, a space inside which the cast-iron F is intended to solidfy progressively along a solidification front from the wall of the die 23. With the casting orifice 20, the head of the die 22 provides an annular space filled by an insulating refractory sleeve 26, the sleeve 26 being intended to form an obstacle for possible cooling flows of the molten cast-iron leaving the basin 19. The tubular die 23 whereof the lower part is situated at the same height as the lower part of the core 21, is surrounded with annular clearance by a tubing casing 27 of metal or a metal alloy which is a good heat conductor, such as copper, which flares out to form a basin 28 at its upper end and which serves as a container for a jacket 29 of molten metal having a low melting point (lead or tin for example) in close contact with the die 23 over the entire height of the latter, with the exception of the head 22. The jacket of molten metal 29 having a low melting point is supplied either from the top through a pipe 30, or from the bottom by a pipe 31 which also serves for the discharge of molten cooling metal 29 when this is necessary. The casing 27 is also surrounded tightly by a hollow cooling sleeve 32 comprising a circulation of water, whereof the inner wall is in contact with the outer wall of the casing 27.

As known, it is just at the outlet of the annular space 25 between the core 21 and the die 23 that a tube T is formed, solidified completely.

(3) Thermal treatment installation:

Mounted below the die 23, on the axis XX of the latter and at a suitable distance from the lower part of the die 23 is a fluidization vat 9 having an annular base comprising an opening 10 for the passage of the tube T and having an annular porous plate 11 also comprising an opening for the passage of the tube T. Above the porous plate 11, the vat 9 contains a bath of fluidized sand 15 cooled by a helical tubular coil comprising turns 16 which are cooled by water. The fluidization vat 9 receives the thermally treated tube T through its upper part instead of receiving it through its opening 10 as in the preceding example. However, the evolution of temperature of the tube T takes place before and during passage through the fluidization vat 9 according to the same curve passing through the points a, b, c of FIG. 5 (bainitisation tempering treatment).

An extractor **33*b* comprising an insulating jacket 34*b* and motorised entrainment rollers 35 then a shaft 33 having an insulating sleeve 34 follow the vat 9 and precede a temperature-maintaining tunnel furnace comprising gas burners, which is not shown but which is like the furnace 44 of FIGS. 2 and 4. Interposed between the extractor 33*b* and the shaft 33 is a device K for cutting the tube T. As shown in FIGS. 1 to 3, the shaft comprises at its lower end a lug 36 and a journal 37 on the tilting axis YY as well as a lug 38** and means for tilting through an angle of 90° which are not shown.

The complete thermal treatment according to the invention takes place under the same conditions as in the example of FIGS. 1, 2, 3, 4 and 5 according to the three stages illustrated in FIG. 5, i.e. the stage of austenitisation-bainitisation tempering first of all along the portion a, b between the die 23 and the fluidization vat 9, then along the portions b, c of sudden temperature drop for bainitisation through the fluidization vat 9 and finally, after cutting of the tube T, along a horizontal portion ef (or isotherm ef) situated in the shaded area comprised between the upper isotherm e1f1 (450° C.) and the lower isotherm e2f2 (250° C.) a stabilisation of temperature occurs inside the maintaining tunnel furnace 44. The thermal treatment is completed by the final stage f1 or f2, g, h of cooling in the atmosphere of the tube T which has left the maintaining bainitisation furnace 44.

The advantages are the same as previously as regards the thermal treamtent, the only difference with the preceding example residing in the method of manufacture of the tube T using the core 21 and advancing the tube T downwards in the direction of arrow f2.

Obtaining a structure other than bainitic:

If one wishes to obtain a structure other than bainitic, for example a structure of bainite+perlite of ferrite+perlite having a perfectly controlled percentage of perlite, whereas previous thermal treatments did not make it possible to reproduce the percentage of perlite from one treatment to the other, nor even from one end of the tube to the other, the treatment of the invention permits this, in a faithful and industrially reproducible manner. In the case of the structure ferrite+perlite, the shaft 33 is eliminated.

Similarly, the treatment of the invention makes it possible to reproduce a structure of bainite+ferrite.

For a structure of bainite+ferrite, the temperature of the fluidized bath 15 should be comprised between 100° and 200° C. as for bainite alone.

For a structure of ferrite+perlite having pre-determined percentages of each of the ferrite and perlite phases, the temperature of the fluidized bath 15 should be such that the cooling speed of the tube T travelling through this bath 15 is constant. In other words, the constant cooling speed of the tube T across a three-phase band alpha+gamma+graphite shown in shading in the thermal diagram of FIG. 7 (the band $\alpha+\gamma+g$ is so called because it illustrates the field of eutectoid transformation of the cast-iron in which the three-phases, ferrite, austenite and graphite of the ternary diagram "iron, carbon, silicon" co-exist) gives rise to chosen proportions of ferrite and perlite.

The constant and adjustable speed of passage of the pipe T through the fluidized bath 15 generates a constant cooling speed across the three-phase band ($\alpha+\gamma+g$) and thus guarantees a constant and previously chosen proportion of each of the phases: ferrite and perlite. The intensity of cooling may be regulated as in the case of bainitic tempering by the choice of the rate of flow of fluidization air (pipe 13) and the choice of the speed of circulation of water in the coil 16. If one wishes to reduce the intensity of cooling, it is possible to eliminate any circulation of water in the coil 16 or even to replace the coil 16 by heating means. These heating means may be for example an electrical heating resistance embedded in the fluidized bath 15 or surrounding the metal vat 9 or even arranged in order to heat the fluidization air (pipe 13). As heating means, gas burners may also be used.

Figure 7:
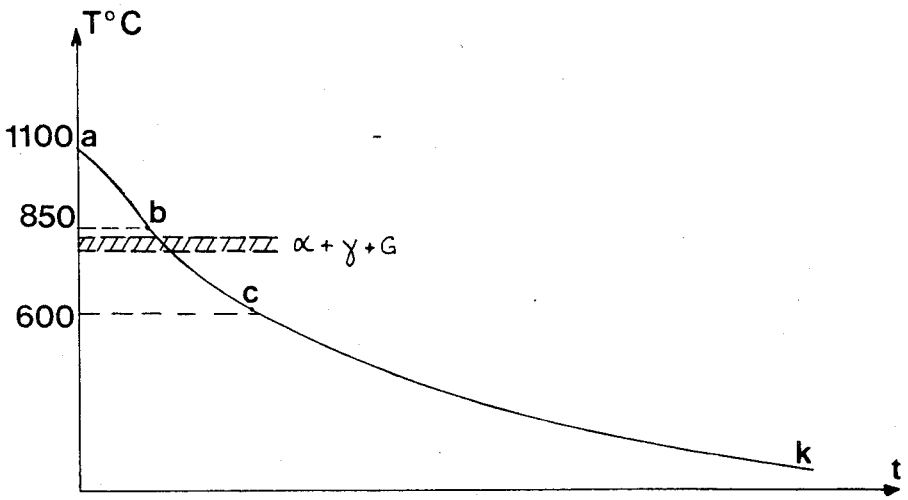
FIG. 7 is a diagram similar to that of FIG. 5 of a variation of thermal treatment for obtaining a ferritoperlitic structure.
Figure 6:
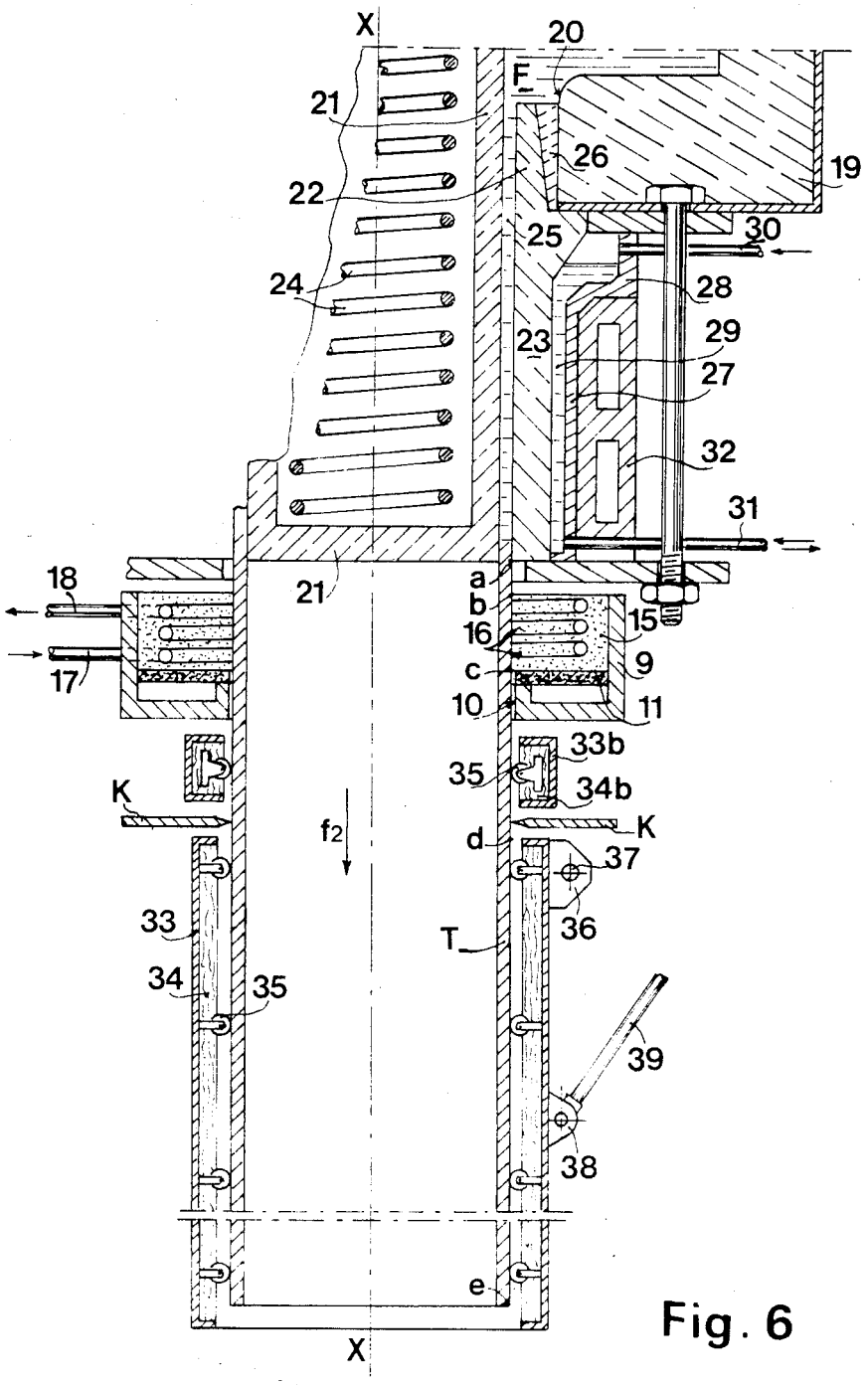
FIG. 6 is a partial diagrammatic sectional view of a variation of the installation of the invention with continuous top casting of a tube from cast-iron without a socket.

In order to obtain this structure of ferrite+perlite, one proceeds according to the diagram "temperature, time" of FIG. 7.

First phase (abc)

In this diagram, the point a corresponds to the emergence of the tube T from the die 4-5. It is the same as in the first example (FIG. 5): the temperature is 1100° C. On entering the fluidized bath, the temperature of the tube T is 850° C. at the point b, as in FIG. 5. On leaving the fluidized bath, at the point c, the temperature of the tube T has dropped to a value greater than 600° C. It should be noted that the drop in temperature according to the diagram of FIG. 7 between the points b and c is much less sudden and much more progressive than in the treatment according to the diagram of FIG. 5.

Between the points b and c is the three-phase band ($\alpha+\gamma+g$) (zone of eutectoid transformation of the cast-iron) in a range of temperatures comprised between 770° C. and 810° C. where the cooling speed of the tube T is constant. The band ($\alpha+\gamma+g$) is shaded.

Second and last phase (ck)

Emerging into the atmosphere at the outlet of the fluidized bath 15 and no longer having any shaft 33 to pass through, the tube T undergoes natural cooling in the atmosphere illustrated by the portion of curve ck.

The continuous thermal treatment of the invention allows a precise regulation of the rate of each phase present (ferrite phase and perlite phase) owing to the constancy of the following parameters:

speed of extraction of the tube T, cooling speed of the same tube, temperatures at all the points of the installation which are comprised between the points a (emergence of the tube T from the die 4-5) and c (emergence of the tube T from the fluidized bath 15).

We claim:

1. Method for the continuous manufacture of pipes from spheroidal graphite cast-iron having a homogeneous and controlled structure chosen from structures containing bainite or bainite and ferrite, of the type in which a tube is formed by a continuous casting method inside a cooled tubular die, from a cast-iron having the following composition by weight: carbon 2.5 to 4%, silicon 2 to 4%, manganese 0.1 to 0.6%, molybdenum 0 to 0.5%, nickel 0 to 3.5%, copper 0 to 11%, magnesium 0 to 0.5%, sulphur 0.1% maximum, phosphorous 0.06% maximum, the remainder being iron, this method being characterized in that, at the outlet (a) of the cooled tubular die (4-5) the tube (T) which has just been produced passes through a first phase of tempering comprising the steps of:

(a) cooling the tube naturally, between the outlet of the cooled tubular die and entry into a fluidized bath, to obtain an austenitic structure;

(b) passing the tube through the fluidized bath, which contains refractory particles cooled to a temperature substantially lower than that of the tube, to forcefully cool the tube to a first temperature; and (c) passing the tube beyond an outlet of the fluidized bath and past a cutting point, and cutting the tube at the cutting point to a predetermined length during an intermediate phase of slow cooling from the first temperature to a second temperature less than said first temperature, and the tube passes through a second phase comprising the steps of:

(d) passing the cut tube through a tunnel furnace to maintain the tube at a constant isothermal temperature to obtain a homogeneous bainitic or bainitic-austenitic structure.

2. Method according to claim 1, wherein the first phase (a, b, c) starts with a tube (T) emerging at the outlet of the die (4-5) at a temperature of the order of 1100° C., the tube cools naturally to a temperature of the order of 850° C. (b) and then the tube (T) is cooled forcefully and uniformly over its entire length by causing it to pass through the fluidized bath of solid refractory particles (c) in order to bring it rapidly to the first temperture which is approximately 500° C. in order to acquire a bainitic structure, and the slow cooling is from 500° C. to the second temperature which has a value comprising between 250° C. and 450° C. (c, d, e) and in the step of passing the cut tube through the tunnel furnace in said second phase the tube is maintained between isothermal limits of 450° C. (e1f1) and 250° C. (e2f2), and wherein the method further comprises a last phase comprising the step of:

cooling the tube in the atmosphere.

3. Method according to claim 1, wherein a temperature between 100° C. and 200° C. is maintained in the fluidized bath in the first phase to produce a tube (T) having a structure at least partly of bainite.

4. An installation for tempering continuously cast-iron tubes including means for the supply of molten cast-iron and means for producing the tubes comprising a cooled tubular die (4, 5, 21, 23) and further comprising; a fluidization vat (9) of solid refractory particles located downstream of said die, the vat being provided with fluidization means (12, 13, 14) to suspend the particles in a gaseous medium and a tubular coil (16) embedded in the fluidized bath (15) with means to circulate water therethrough and the vat comprising at least one orifice (10) for the tube (T) which has to pass through the fluidized bath (15) of the particles in the vat (9).

5. Installation according to claim 4, wherein the cooled tubular die (4, 5; 21, 23) is on a vertical axis (X—X), and the fluidization vat (9) comprises a single orifice (10) on a vertical axis at its lower end and is open to the atmosphere at its upper end.

6. Installation according to claim 5, wherein the cooled tubular die (4, 5) on a vertical axis (X—X) is supplied with molten cast-iron from a bottom casting orifice (3) in a base of the die, the fluidization vat (9) is located above the cooled die (4, 5) and the single orifice (10) of the vat (9) is an inlet opening for the tube (T).

7. Installation according to claim 4, wherein the tubular die (21, 23) on the vertical axis (X—X) is supplied with molten cast-iron from a top portion thereof and is combined with a core (21) which defines the inner diameter of the tubes, the fluidization vat (9) is located below the cooled die (23) and the single orifice (10) of the vat (9) is an outlet opening for the tube (T).

8. Installation according to claim 4 for producing a tube having a structure which is at least partly bainitic, further comprising; extracting means (33*a;* 33*b*) located downstream of said vat for withdrawing the tube from the vat, and a shaft (33) surrounding an insulating sleeve (34) and disposed coaxially around the tube for gradually cooling the tube as it is withdrawn by the extracting means.

9. Installation according to claim 8, wherein the shaft (33) is provided internally with rollers (35) for guiding, supporting and entraining the tube (T) and is provided externally with a lug (36) for articulation about a horizontal axis (Y—Y) for pivoting the shaft (33) through 90° by tilting means (39-40) in order to pass from a position on a vertical axis (X—X) to a horizontal position (X1—X1) coaxial with an inlet (42) of a tunnel furnace (44) on a horizontal axis (X1'X1) for maintaining the bainitisation temperature of the tube (T).

* * * * *